US009976204B2

(12) United States Patent
Dolman

(10) Patent No.: US 9,976,204 B2
(45) **Date of Patent: *May 22, 2018**

(54) METAL ALLOYS FOR HIGH IMPACT APPLICATIONS

(71) Applicant: Weir Minerals Australia Ltd, Artarmon, New South Wales (AU)

(72) Inventor: Kevin Dolman, Epping (AU)

(73) Assignee: Weir Minerals Australia Ltd, Artamon, New South Wales (AU)

( * ) Notice: Subject to any disclaimer, the term of this patent is extended or adjusted under 35 U.S.C. 154(b) by 218 days.

This patent is subject to a terminal disclaimer.

(21) Appl. No.: 14/728,297

(22) Filed: Jun. 2, 2015

(65) Prior Publication Data

US 2015/0267283 A1 Sep. 24, 2015

Related U.S. Application Data

(63) Continuation of application No. 13/576,536, filed as application No. PCT/AU2011/000091 on Feb. 1, 2011, now Pat. No. 9,273,385.

(30) Foreign Application Priority Data

Feb. 1, 2010 (AU) ..... 2010900377
Oct. 1, 2010 (AU) ..... 2010904415

(51) Int. Cl.
*C22C 37/10* (2006.01)
*C22C 37/06* (2006.01)
(Continued)

(52) U.S. Cl.
CPC ..... *C22C 38/38* (2013.01); *B22D 25/06* (2013.01); *C21D 5/04* (2013.01); *C21D 6/002* (2013.01); *C21D 6/005* (2013.01); *C21D 6/008* (2013.01); *C22C 33/08* (2013.01); *C22C 37/06* (2013.01); *C22C 37/10* (2013.01)

(58) Field of Classification Search
None
See application file for complete search history.

(56) References Cited

U.S. PATENT DOCUMENTS 1,245,552 A 11/1917 Becket
4,441,939 A 4/1984 Lemkey et al.

FOREIGN PATENT DOCUMENTS

AU 458985 7/1973
AU 458670 B 9/1973
(Continued)

OTHER PUBLICATIONS

United States Patent Office Notice of Allowance for Application No. 13/576,536 dated Oct. 15, 2015 (6 pages).
(Continued)

*Primary Examiner* — Deborah Yee
(74) *Attorney, Agent, or Firm* — Michael Best & Friedrich LLP

(57) ABSTRACT

A casting of a white cast iron alloy and a method of producing the casting are disclosed. A white cast alloy is also disclosed. The casting has a solution treated microstructure that comprises a ferrous matrix of retained austenite and chromium carbides dispersed in the matrix, with the carbides comprising 15 to 60% volume fraction of the alloy. The matrix composition comprises: manganese: 8 to 20 wt %; carbon: 0.8 to 1.5 wt %; chromium: 5 to 15 wt %; and iron: balance (including incidental impurities).

3 Claims, 1 Drawing Sheet

(51) Int. Cl.

| | |
|---|---|
| ***C22C 38/38*** | (2006.01) |
| ***C22C 38/26*** | (2006.01) |
| ***C22C 38/28*** | (2006.01) |
| ***C21D 5/04*** | (2006.01) |
| ***C22C 33/08*** | (2006.01) |
| ***B22D 25/06*** | (2006.01) |
| ***C21D 6/00*** | (2006.01) |

(56) References Cited

FOREIGN PATENT DOCUMENTS

| | | | |
|---|---|---|---|
| GB | 340382 | | 1/1931 |
| WO | 84/04760 | A1 | 12/1984 |
| WO | 2005/040441 | A1 | 5/2005 |

OTHER PUBLICATIONS

International Search Report for Application No. PCT/AU2011/000091 dated Feb. 24, 2011 ( 3 pages).
International Preliminary Report on Patentability for Application No. PCT/AU2011/000091 dated May 16, 2012 (10 pages).

METAL ALLOYS FOR HIGH IMPACT APPLICATIONS

CROSS-REFERENCE TO RELATED APPLICATIONS

This application is a continuation of U.S. patent application Ser. No. 13/576,536, filed on Aug. 1, 2012, now U.S. Pat. No. 9,273,385, which is a national stage entry of PCT/AU2011/000091, filed on Feb. 1, 2011, which claims priority to Australian Patent Application No. 2010904415, filed on Oct. 10, 2010, and to Australian Patent Application No. 2010900377, filed on Feb. 1, 2010.

FIELD OF THE INVENTION

This invention relates to metal alloys for high impact applications and particularly, although by no means exclusively, to alloys of iron having high toughness, and castings of these alloys.

BACKGROUND

High chromium white cast iron, such as disclosed in U.S. Pat. No. 1,245,552, is used extensively in the mining and mineral processing industry for the manufacture of equipment that is subject to severe abrasion and erosion wear, for example slurry pumps and pipelines, mill liners, crushers, transfer chutes and ground-engaging tools. The high chromium white cast iron disclosed in the US patent comprises 25-30 wt % Cr, 1.5-3 wt % C, up to 3 wt % Si, and balance Fe and trace amounts of Mn, S, P, and Cu.

The microstructures of high chromium white cast iron contain extremely hard (around 1500 HV—according to Australian Standard 1817, part 1) chromium carbides $(Fe, Cr)_7C_3$ in a ferrous matrix with a hardness of about 700 HV. These carbides provide effective protection against the abrasive or erosive action of silica sand (around 1150 HV) which is the most abundant medium encountered in ores fed to mining and mineral processing plants.

In general terms, high chromium white cast iron offers greater wear resistance than steels which have been hardened by quench-and-temper methods, and also provides moderate corrosion resistance compared to stainless steels. However, white cast iron has a low fracture toughness (<30 MPa·√m), making it unsuitable for use in high impact situations such as in crushing machinery.

Fracture toughness is a function of (a) the carbide content, and its particle size, shape, and distribution throughout the matrix, and (b) the nature of the ferrous matrix, i.e. whether it comprises austenite, martensite, ferrite, pearlite or a combination of two or more of these phases.

Furthermore, high chromium white cast iron has low thermal shock resistance and cannot cope with very sudden changes of temperature.

Previous attempts by the inventor to produce a tougher white cast iron by adding quantities of other elements such as manganese to high chromium white cast iron were unsuccessful. Specifically, the various alloying elements in white cast iron, namely chromium, carbon, manganese, silicon, nickel and iron, can partition differently during solidification, resulting in a wide range of potential chemical compositions in the ferrous matrix. For example, it is possible to obtain a white cast iron with a ferrous matrix containing more than 1.3 wt % carbon, but this can result in the presence of embrittling proeutectoid carbides in the microstructure. It is also possible to obtain a white cast iron with a ferrous matrix containing less than 0.8 wt % carbon, but this can result in an unstable austenitic ferrous matrix with a low work hardening capacity. Furthermore, it is possible to obtain a white cast iron with a ferrous matrix containing a low chromium content, which can result in poor corrosion resistance.

This disclosure is concerned particularly, although by no means exclusively, with the provision of a high chromium white cast iron which has an improved combination of toughness and hardness. It is desirable that the high chromium white cast iron be suitable for high impact abrasive wear applications, such as used in crushing machinery or slurry pumps.

SUMMARY OF THE DISCLOSURE

Through experimental work carried out by the applicant, it has been unexpectedly discovered that an inverse relationship exists between the chromium and carbon concentrations of the ferrous matrix formed during solidification of a range of high chromium cast irons. Quantification of this inverse relationship between chromium and carbon in the ferrous matrix has made it possible for the applicant to provide bulk chemical compositions of selected high chromium cast irons containing manganese that result in microstructures containing phases with the required chemistries to yield white cast irons with toughness, work hardening capacity, wear resistance and corrosion resistance to be suitable for use in high impact abrasive wear applications.

The experimental work carried out by the applicant revealed that chromium has a significant impact on the carbon content in the ferrous matrix where previously there was no understanding of this effect. It was thought previously that chromium largely formed carbides of the form $M_7C_3$ carbides (where "M" comprises Cr, Fe, and Mn), i.e. carbides having a high ratio of chromium to carbon. The experimental work, however, identified that considerable chromium is retained in solid solution and that there exists an inverse relationship between chromium content in the ferrous matrix and the amount of carbon that is retained in the ferrous matrix of high chromium white cast irons, whereby as the bulk chromium concentration of a high chromium white cast iron increases the chromium in the matrix of the alloy increases and the carbon in the matrix decreases.

The experimental work carried out by the applicant has shown that, during solidification of high chromium cast irons, chromium and carbon partition preferentially to the primary and eutectic $M_7C_3$ carbides leaving a residual amount of chromium and carbon in the ferrous matrix. In addition, the applicant has shown that when 12 wt % manganese is added to high chromium cast iron, the manganese, to a first approximation, is evenly distributed between the $M_7C_3$ carbides and the ferrous matrix—that is, both the carbides and the ferrous matrix contain a nominal 12 wt % manganese.

The applicant therefore believes that it is possible to obtain a predetermined amount of chromium and carbon in the ferrous matrix of high chromium cast irons containing 8-20 wt % manganese, by having regard to the following findings of the applicant for the partitioning of chromium and carbon in these alloys during the solidification process.

Finding No. 1—When about 12 wt % manganese is added to high chromium cast irons the manganese does not partition preferentially to any particular phase and is approximately evenly distributed between the carbides and ferrous matrix.

Finding No. 2—The residual carbon content of the ferrous matrix is inversely proportional to the residual chromium content of the ferrous matrix. For example, experimental work carried out by the applicant found that when a high chromium cast iron, with a bulk chemical composition of Fe-20Cr-3.0C solidifies, the residual chemical composition of the ferrous matrix is approximately Fe-12Cr-1.1C, compared to an example where, when a bulk chemical composition of Fe-10Cr-3.0C solidifies, the residual chemical composition of the ferrous matrix is approximately Fe-6Cr-1.6C, and compared to an example where, when a bulk chemical composition of Fe-30Cr-3.0C solidifies, the residual chemical composition of the ferrous matrix is approximately Fe-18Cr-0.8C.

The applicant has further found that the chemistry of the ferrous matrix of a bulk alloy Fe-20Cr-12Mn-3.0C is Fe-12Cr-12Mn-1.1C after solidification (that is a 12 wt % Mn and 1.1 wt % C ferrous matrix containing 12 wt % Cr in solid solution).

Accordingly, there is provided a casting of a white cast iron alloy having the following ferrous matrix chemistry in a solution treated condition;

manganese: 8 to 20 wt % carbon: 0.8 to 1.5 wt %;

chromium: 5 to 15 wt %; and iron: balance (including incidental impurities); and having a microstructure comprising:

(a) retained austenite as the matrix; and (b) carbides dispersed in the matrix, the carbides comprising 5 to 60% volume fraction of the casting.

The term "solution treated condition" is understood herein to mean heating the alloy to a temperature and holding the alloy at the temperature for a time to dissolve the carbides and quickly cooling the alloy to room temperature to retain the microstructure.

The chromium concentration and/or the carbon concentration in the bulk chemistry of the white cast iron alloy may be selected having regard to an inverse relationship between chromium concentration and carbon concentration in the matrix to control the matrix concentration of one or both of the chromium and the carbon to be within the above-described ranges so that the casting has required properties, such as toughness and/or hardness and/or wear resistance and/or work hardening capacity and/or corrosion resistance.

For example, the chromium concentration in the bulk chemistry of the white cast iron alloy may be selected having regard to the inverse relationship between chromium concentration and carbon concentration in the matrix to control the matrix concentration of carbon to be greater than 0.8 wt % and less than 1.5 wt %, typically less than 1.2 wt %, typically more than 1 wt % in the solution treated condition. In this example, the manganese concentration in the bulk chemistry may be 10-16, typically 10-14 wt %, and more typically 12 wt %.

The concentrations of chromium, carbon and manganese in the bulk chemistry of the white cast iron alloy may be selected so that the casting has the following mechanical properties in the solution treated form of the casting:

Tensile strength: at least 650, typically at least 750 MPa.

Yield strength: at least 500, typically at least 600 MPa.

Fracture toughness: at least 50, typically at least 60 MPa√m.

Elongation: at least 1.2%

Hardness: at least 350, typically at least 400 Brinell.

Plastically deformability under compressive load: at least 10%

High work hardening capacity: up to at least 550 Brinell in service.

The carbides may be 5 to 60% volume fraction of the casting, typically 10 to 40% volume fraction of the casting, and more typically 15-30% volume fraction of the casting. The microstructure may comprise 10 to 20 volume % carbides dispersed in the retained austenite matrix.

The carbides may be chromium-iron-manganese carbides.

The carbide phase of the above casting after solution treatment may be primary chromium-iron-manganese carbides and/or eutectic chromium-iron-manganese carbides and the retained austenite matrix may be primary austenite dendrites and/or eutectic austenite.

The carbides may also be niobium carbide and/or a chemical mixture of niobium carbide and titanium carbide. Metal alloys containing these carbides are described in the patent specification entitled "Hard Metal Material" lodged on 1 Feb. 2011 with an International application in the name of the applicant and the entire patent specification of this application is incorporated herein by cross-reference.

The patent specification mentioned in the preceding paragraph describes that the terms "a chemical mixture of niobium carbide and titanium carbide" and "niobium/titanium carbides" are understood to be synonyms. In addition, the patent specification describes that the term "chemical mixture" is understood in this context to mean that the niobium carbides and the titanium carbides are not present as separate particles in the mixture but are present as particles of niobium/titanium carbides.

For carbide volume fractions below 5%, the carbides do not make a significant contribution to the wear resistance of the alloy. However, for carbide volume fractions greater than 60%, there is insufficient ferrous matrix to hold the carbides together. As a result, the fracture toughness of the alloy may be unsuitable for crushing machinery.

The matrix may be substantially free of ferrite.

The term "substantially free of ferrite" indicates that the intention is to provide a matrix that comprises retained austenite without any ferrite but at the same time recognises that in any given situation in practice there may be a small amount of ferrite.

The white cast iron alloy of the casting may have a bulk composition comprising:

chromium: 10 to 40 wt %;

carbon: 2 to 6 wt %;

manganese: 8 to 20 wt %;

silicon: 0 to 1.5 wt %; and balance of iron and incidental impurities.

The white cast iron alloy may comprise 0.5 to 1.0 wt % silicon.

The white cast iron alloy may comprise 2 to 4 wt % carbon.

The white cast iron alloy of the casting may have a bulk composition comprising:

chromium: 7 to 36 wt %;

carbon: 3 to 8.5 wt %;

manganese: 5 to 18 wt %;

silicon: 0 to 1.5 wt %;

titanium: 2 to 13 wt %; and balance of iron and incidental impurities.

The white cast iron alloy of the casting may have a bulk composition comprising:

chromium: 7 to 36 wt %;

carbon: 3 to 8.5 wt %;

manganese: 5 to 18 wt %;

silicon: 0 to 1.5 wt %;

niobium: 8 to 33 wt %; and balance of iron and incidental impurities.

The white cast iron alloy of the casting may have a bulk composition comprising:

chromium: 7 to 36 wt %;
carbon: 3 to 8.5 wt %;
manganese: 5 to 18 wt %;
silicon: 0 to 1.5 wt %;
niobium and titanium: 5 to 25 wt %; and
balance of iron and incidental impurities.

The white cast iron alloy of the casting may have a bulk composition comprising chromium, carbon, manganese, silicon, any one or more of the transition metals titanium, zirconium, hafnium, vanadium, niobium, tantalum, chromium, molybdenum and tungsten; and balance of iron and incidental impurities, with the amount of the transition metal or metals selected so that carbides of these metal or metals in the casting comprise up to 20 volume % of the casting.

The casting may be equipment that is subject to severe abrasion and erosion wear, such as slurry pumps and pipelines, mill liners, crushers, transfer chutes and ground-engaging tools.

There is also provided equipment that is subject to severe abrasion and erosion wear, such as slurry pumps and pipelines, mill liners, crushers, transfer chutes and ground-engaging tools that includes the casting.

The equipment may be crushing machinery or slurry pumps.

There is also provided a white cast iron alloy comprising the following bulk chemistry:

chromium: 10 to 40 wt %;
carbon: 2 to 6 wt %;
manganese: 8 to 20 wt %;
silicon: 0 to 1.5 wt %; and
balance of iron and incidental impurities.

The white cast iron alloy may comprise 12 to 14 wt % manganese.

The white cast iron alloy may comprise 0.5 to 1.0 wt % silicon.

The white cast iron alloy may comprise 2 to 4 wt % carbon.

There is also provided a white cast iron alloy comprising the following bulk chemistry:

chromium: 7 to 36 wt %;
carbon: 3 to 8.5 wt %;
manganese: 5 to 18 wt %;
silicon: 0 to 1.5 wt %;
titanium: 2 to 13 wt %; and
balance of iron and incidental impurities.

There is also provided a white cast iron alloy comprising the following bulk chemistry:

chromium: 7 to 36 wt %;
carbon: 3 to 8.5 wt %;
manganese: 5 to 18 wt %;
silicon: 0 to 1.5 wt %;
niobium: 8 to 33 wt %; and
balance of iron and incidental impurities.

There is also provided a white cast iron alloy comprising the following bulk chemistry:

chromium: 7 to 36 wt %;
carbon: 3 to 8.5 wt %;
manganese: 5 to 18 wt %;
silicon: 0 to 1.5 wt %;
niobium and titanium: 5 to 25 wt %; and
balance of iron and incidental impurities.

There is also provided a white cast iron alloy comprising a bulk chemistry comprising chromium, carbon, manganese, silicon, any one or more of the transition metals titanium, zirconium, hafnium, vanadium, niobium, tantalum, chromium, molybdenum and tungsten; and balance of iron and incidental impurities, with the amount of the transition metal or metals selected so that carbides of these metal or metals in a solid form of the alloy comprise up to 20 volume % of the solid form.

There is also provided a method of producing a casting of the above-described white cast iron alloy, the method comprising the steps of:

(a) forming a melt of the above-described white cast iron alloy;
(b) pouring the melt into a mould to form the casting; and
(c) allowing the casting to cool substantially to room temperature.

Step (a) of the method may comprise adding (a) niobium or (b) niobium and titanium to the melt in a form that produces particles of niobium carbide and/or particles of a chemical mixture of niobium carbide and titanium carbide in a microstructure of the casting. The method may include additional method steps as described in the above-mentioned specification entitled "Hard Metal Material" lodged on 1 Feb. 2011 with the above-mentioned International application in the name of the applicant. As is indicated above, the entire patent specification of this application is incorporated herein by cross-reference.

The method may further comprise heat treating the casting after step (c) by:

(d) heating the casting to a solution treatment temperature; and
(e) quenching the casting.

Step (e) may comprise quenching the casting in water.

Step (e) may comprise quenching the casting substantially to room temperature.

The resulting microstructure may be a matrix of retained austenite and carbides dispersed in the matrix, the carbides comprising 5 to 60% volume fraction of the casting The resulting ferrous matrix may be austenitic to the extent that it is substantially free of ferrite. The resulting ferrous matrix may be wholly austenitic due to the rapid cooling process.

The solution treatment temperature may be in a range of 900° C. to 1200° C., typically 1000° C. to 1200° C.

The casting may be retained at the solution treatment temperature for at least one hour, but may be retained at the said solution treatment temperature for at least two hours, to ensure dissolution of all secondary carbides and attainment of chemical homogenization.

BRIEF DESCRIPTION OF THE DRAWINGS

The white cast iron alloy and casting will now be described further by way of example only, and with reference to the accompanying drawings, in which.

DETAILED DESCRIPTION

Although a range of white cast iron alloy compositions are with the scope of the present invention, the following description is directed to one cast iron alloy in particular as an example.

It is noted that the applicant has carried out extensive experimental work in relation to the white cast iron alloy of the present invention that has established the upper and lower limits of the ranges of the elements and the volume fractions of the carbides in the following as-cast microstructure of the present invention comprising:

(a) a ferrous matrix comprising retained austenite, the matrix having a composition of:
manganese: 8 to 20 wt %
carbon: 0.8 to 1.5 wt %;
chromium: 5 to 15 wt %; and
iron: balance (including incidental impurities); and (b) chromium carbides comprising 5 to 60% volume fraction.

The example white cast iron alloy had the following bulk composition:

chromium: 20 wt %;
carbon: 3 wt %;
manganese: 12 wt %;
silicon: 0.5 wt %; and
a balance of iron and incidental impurities.

A melt of this white cast iron alloy was prepared and cast into samples for metallurgical test work, including hardness testing, toughness testing and metallography.

The test work was performed on as-cast samples that were allowed to cool in moulds to room temperature. Test work was also carried out on the as-cast samples that were then subjected to a solution heat treatment involving reheating the as-cast samples to a temperature of 1200° C. for a period of 2 hours followed by a water quench.

A summary of the hardness and toughness test results is set out in Table 1 below.

TABLE 1

Summary of Test Results

| Alloy form | Hardness (HV50) | Hardness (HB - converted) | Fracture Toughness (MPa√m) | Ferrite meter reading |
|---|---|---|---|---|
| As cast | 413 | 393 | 49.85 | 0% |
| Solution treated at 1200 Celsius | 446 | 424 | 56.35 | 0% |

Figure 1:
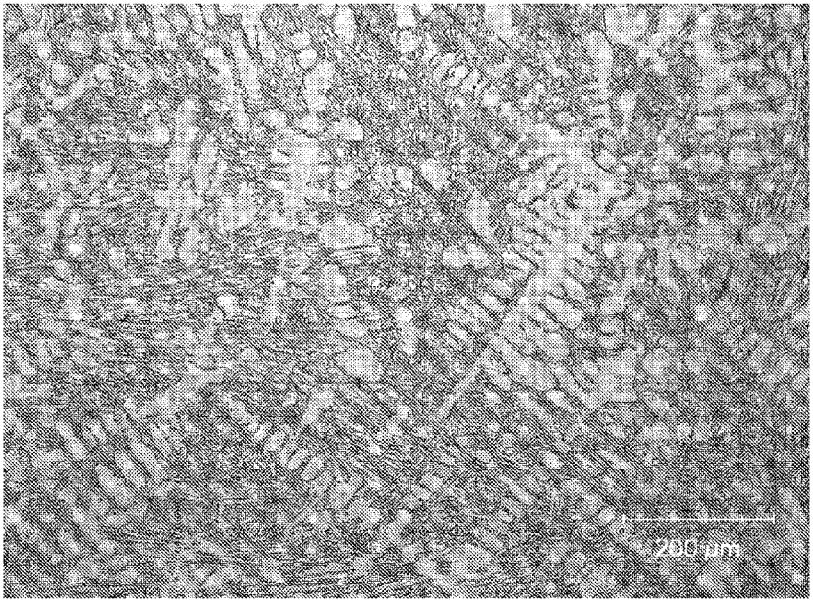
FIG. 1 is a micrograph of the microstructure of an as-cast iron alloy in accordance with an embodiment of the inventions.
Figure 2:
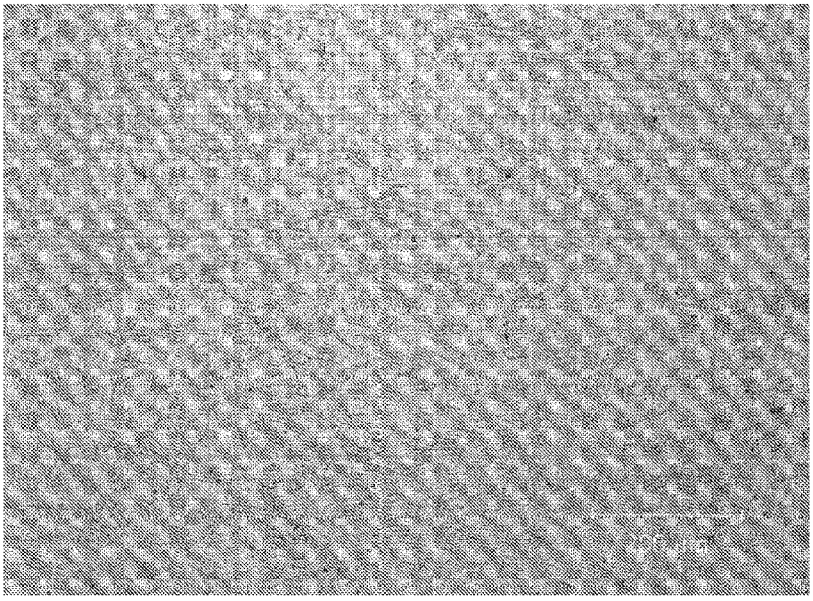
FIG. 2 is a micrograph of the microstructure of the as-cast iron alloy in FIG. 1 after heat treatment.

The microstructure of the white cast iron alloy in the as-cast form (FIG. 1) shows large austenite dendrites in a matrix of eutectic austenite. By contrast, the solution heat treated form of the iron alloy (FIG. 2) shows austenite dendrites generally well dispersed in a retained austenite matrix. The ferrite meter readings for the as-cast and solution heat treated samples (that is, magnetism readings), show that the samples were non-magnetic. This, therefore, indicates that the castings did not include ferrite or martensite or pearlite in the ferrous matrix.

Compositional analysis of the retained austenite matrix is revealed a chromium content in the matrix solid solution of about 12 wt % and a carbon content in the matrix of about 1.1 wt %. The retained austenite matrix therefore can be regarded as a manganese steel with relatively high chromium content in solid solution for improved hardness and improved corrosion resistance, which are not features of conventional austenitic manganese steel.

Additionally, the volume percentage of chromium carbides contributed to hardness and overall wear resistance. Although the hardness results in Table 1 are below typical hardness measurements of wear resistant cast iron alloys, it was found that hardness of the iron alloy increased after work hardening treatments to a level that is comparable to hardness of known wear resistant cast iron alloys.

Further samples of the same white cast iron alloy were cast and then subjected to heat treatment at 1200° C. for a period of 2 hours.

The samples had a microstructure comprising primary austenite dendrites plus eutectic carbides and eutectic austenite.

Microanalysis of the samples revealed the following:

Both the elements chromium and carbon partition heavily to the carbide phase which was identified as $(Fe, Cr, Mn)_7C_3$ by Electron Back Scattered Diffraction.

To a first approximation, the element manganese is evenly distributed between the carbides and austenite phases.

11.3% by volume of the microstructure consisted of primary austenite dendrites.

22.3% by volume of the microstructure consisted of eutectic carbides.

66.4% by volume of the microstructure consisted of eutectic austenite.

The carbon content of the austenite phase was 0.98 wt %.

The manganese content of the austenite phases was 11.8 wt % and 11.6 wt %.

The ferrous matrix of the alloy consisted of 11.3% by volume primary austenite dendrites and 66.4% by volume eutectic austenite.

The chemistry of the ferrous matrix was Fe-12Cr-12Mn-1.0C-0.4Si, which is essentially a basic manganese steel containing 12% chromium in solid solution.

Fracture toughness testing was carried out on two samples according to the procedure described in "*Double Torsion Technique as a Universal Fracture Toughness Method*", Outwater, J. O. et al., Fracture Toughness and Slow-Stable Cracking, ASTM STP 559, American Society for Testing and Materials, 1974, pp 127-138.

The applicant found that the presence of manganese in the alloy allowed the ferrous matrix to become surface work hardened by the action of compressive loading during service to provide a material with moderate wear resistance and excellent toughness, attributable to the presence of a metastable austenitic structure formed by water quenching of the casting from a temperature of about 1200° C. to room temperature. The wholly austenitic structure could be retained during cooling to room temperature due to the presence of both a high manganese content and a specific carbon content.

Because of the synergistic combination of the presence of the manganese, a casting that was made out of a white cast iron alloy of the invention offers significantly improved fracture toughness compared to regular high chromium white cast iron, in combination with the advantages of white cast iron of (a) high abrasion and erosion wear resistance, (b) relatively high yield strength, and (c) moderate corrosion resistance in acidic environments.

The white cast iron alloy of the above-mentioned example had an average fracture toughness of 56.3 MPa√m. This result compares favourably with toughness values of 25-30 MPa·√m. for high chromium white cast irons. It is anticipated that this fracture toughness makes the alloys suitable for use in high impact applications, such as pumps, including gravel pumps and slurry pumps. The alloys are also suitable for machinery for crushing rock, minerals or ore, such as primary crushers.

One advantage of the white cast iron alloy of the present invention is that hot working of the as formed alloy breaks up the carbide into discrete carbides, thereby improving the ductility of the alloy.

Reference to any prior art in the specification is not, and should not be taken as, an acknowledgment or any form of suggestion that this prior art forms part of the common general knowledge in Australia or any other country.

Many modifications may be made to the preferred embodiment of the present invention as described above without departing from the spirit and scope of the present invention.

It will be understood that the term "comprises" or its grammatical variants as used in this specification and claims is equivalent to the term "includes" and is not to be taken as excluding the presence of other features or elements.

The invention claimed is:

1. A white cast iron alloy comprising the following bulk chemistry:

chromium: 7 to 36 wt %;
carbon: 3 to 8.5 wt %;
manganese: 5 to 18 wt %;
silicon: 0 to 1.5 wt %;
titanium: greater than 5 wt % to 13 wt %; and
balance of iron and incidental impurities.

2. A white cast iron alloy comprising the following bulk chemistry:

chromium: 7 to 36 wt %;
carbon: 3 to 8.5 wt %;
manganese: 5 to 18 wt %;
silicon: 0 to 1.5 wt %;
niobium: greater than 10 wt % to 33 wt %; and
balance of iron and incidental impurities.

3. A white cast iron alloy comprising the following bulk chemistry:

chromium: 7 to 36 wt %;
carbon: 3 to 8.5 wt %;
manganese: 5 to 18 wt %;
silicon: 0 to 1.5 wt %;
niobium and titanium: greater than 10 wt % to 25 wt %; and
balance of iron and incidental impurities.

* * * * *